US006646387B2

(12) United States Patent
Chae et al.

(10) Patent No.: US 6,646,387 B2
(45) Date of Patent: Nov. 11, 2003

(54) AC-TYPE PLASMA DISPLAY PANEL HAVING ENERGY RECOVERY UNIT IN SUSTAIN DRIVER

(75) Inventors: Gyun Chae, Gyeonggi-Do (KR); Beom Gu Kang, Seoul (KR); Bong Chool Kim, Gyeonggi-Do (KR)

(73) Assignee: Ultra Plasma Display Corporation, Gyeonggi-Do (KR)

( * ) Notice: Subject to any disclaimer, the term of this patent is extended or adjusted under 35 U.S.C. 154(b) by 0 days.

(21) Appl. No.: 10/188,380

(22) Filed: Jul. 1, 2002

(65) Prior Publication Data

US 2003/0006712 A1 Jan. 9, 2003

(30) Foreign Application Priority Data

Jul. 3, 2001 (KR) ..... 2001-39490

(51) Int. Cl.[7] ..... H05B 37/00
(52) U.S. Cl. ..... 315/165; 315/209 R; 345/76
(58) Field of Search ..... 315/165, 169.3, 315/169.4, 108, 168, 244, 209 R; 345/60, 41, 76; 340/643, 593

(56) References Cited

U.S. PATENT DOCUMENTS 4,866,349 A * 9/1989 Weber et al. ..... 315/169.1
5,642,018 A * 6/1997 Marcotte ..... 315/209 R
5,943,030 A * 8/1999 Minamibayashi ..... 345/60

* cited by examiner

*Primary Examiner*—Dong Wong
*Assistant Examiner*—Jimmy T. Vu
(74) *Attorney, Agent, or Firm*—Blakely, Sokoloff, Taylor & Zafman

(57) ABSTRACT

An apparatus of a sustain driver in an AC-type plasma display panel having an energy recovery unit, comprising: a first drive unit for driving one electrode of a panel capacitor to a sustain voltage or a ground voltage; a second drive unit for driving another electrode of the panel capacitor to a sustain voltage or a ground voltage; and a common energy recovery unit. The common energy recovery unit includes: an inductor connected to the one electrode of the panel capacitor and form a L-C resonance circuit with the panel capacitor; a first and second external capacitors connected in series between the power source of the sustain voltage and the ground; and a switch unit for selectively switching the L-C resonance circuit and the first and second external capacitors during the charge and discharge operation of the panel capacitor.

11 Claims, 4 Drawing Sheets

AC-TYPE PLASMA DISPLAY PANEL HAVING ENERGY RECOVERY UNIT IN SUSTAIN DRIVER

FIELD OF THE INVENTION

The present invention relates to a plasma display panel technology; and, more particularly, to an ac-type plasma display panel having an energy recovery unit in a sustain driver.

A plasma display panel (PDP) is a device for displaying a picture and it has been known as a gas discharge display device. Discharge gases, such as Kr and Xe, are filled up between upper and lower panels of the plasma display panel, and an ultraviolet ray generated through the gas discharge exciting red, green and yellow fluorescents, which are formed at least one of the upper and lower panels thereby to generate visible lights.

The PDP is classified into a DC type and an AC type. In the DC type PDP, electrodes for applying voltage to the panel is exposed directly to the discharge gas so that a current directly flows between electrodes in order to form the plasma. Therefore, it is advantageous that the structure is relatively simple. On the other hand, it has disadvantage that the external resistor has to be placed to limit the current. In the AC type PDP, the electrodes are covered with the dielectric substances so that the electrodes are not exposed directly to the discharge gas in order to flow a displacement current. The AC type PDP has longer life span, compared with the DC type PDP, because the electrodes of the AC type PDP can be protected from an ion impact by covering the electrodes with the dielectric substances to limit the current naturally. The AC type PDP can be classified into an opposite discharge type and a surface discharge type. The opposite discharge type has the disadvantage that the life span is shortened by the degradation of the fluorescent substances owing to the ion impact. In the surface discharge type, on the other hand, the discharge is generated near the front panel opposite to the fluorescent substances in order to minimize the degradation of the fluorescent substances, therefore, the surface discharge type is adopted to most of the PDP manufacturing processes.

In the AC type PDP, the high voltage has to be applied continuously and alternately between the sustain electrodes (X electrode and Y electrode) in the discharge cell during the operation of the PDP. Therefore, the dielectric substances are spread over the sustain electrodes so that a panel capacitor exists between X electrode and Y electrode.

In order to alternatively apply the positive and negative high voltage between the sustain electrodes during the operation of the PDP, the charge and discharge operations of the panel capacitor has to be performed. However, the power is consumed considerably by the panel capacitor during the charge and discharge operations, and the power loss problem of a panel drive circuit is generated because the capacitance of the panel capacitor is increased in proportion to the size of the panel.

In order to solve the power loss problems in the panel drive circuit, an energy recovery unit is adopted to the conventional panel drive circuit. In the energy recovery unit, an inductor for forming a LC resonance circuit with the panel capacitor is used to recover the energy loss during the discharge of the panel capacitor. The energy is stored in the inductor through the recovery, and the stored energy is used during the next charge operation of the panel capacitor to reduce the power loss.

A conventional circuit structure of a Weber-type sustain driver in the PDP having an energy recovery unit is shown in FIG. 1.

Referring to FIG. 1, a sustain driver, in the PDP having the energy recovery unit, includes a first and second sustain drivers 100 and 200 which are connected across a panel capacitor Cp.

Each sustain driver 100 and 200 includes a driving unit 12 and 22 and an energy recovery unit 10. The driving unit 12 and 22 drive the panel capacitor Cp to a sustain voltage Vsus or the ground voltage. The energy recovery units 10 and 20 recovery the energy loss caused during the discharge operation of the panel capacitor Cp and provides the recovered energy to the panel capacitor Cp during the next charge operation.

The first and second sustain drivers 100 and 200 have symmetrical configuration across the panel capacitor Cp. During the charge and discharge operations, the voltage Vp of the panel capacitor Cp is swung to positive and negative voltage by the first and second sustain drivers 100 and 200 operating alternatively with each other.

The driving unit 12 of the first sustain driver 100 includes a first switch S1 and a second switch S2. The first switch is connected to a power source of the sustain voltage Vsus and the panel capacitor Cp and transfers the sustain voltage to the panel capacitor. The second switch S2 is connected the ground and the panel capacitor Cp and transfers the ground voltage to the panel capacitor. The driving unit 22 of the second sustain driver 200 also includes two switch S5 and S6 as in the driving unit 12 of the first driving unit 100.

The first energy recovery unit 10 in the first sustain driver 100 includes an inductor Lr, an external capacitor Ce, third and fourth switches S3 and S4, and first and second diodes D1 and D2. The second energy recovery unit 20 of the second sustain driver 200 also includes the same element as in the first energy recovery unit 10 of the first sustain driver 100.

The inductor Lr is connected to the panel capacitor Cp for operating the panel capacitor Cp with a half resonance. The external capacitor Ce stores the energy recovered by the resonance operation of the inductor Lr and the panel capacitor Cp. The third and fourth switches S3 and S4, coupling in parallel, are connected to the external capacitor Ce for switching an energy recovery path. The first and second diodes D1 and D2, coupled in parallel and to reversal direction with each other, are respectively connected to the third and fourth switches S3 and S4. The inductor Lr is connected to the first and second diodes D1 and D2 in order to prevent a reverse of resonance current IL.

Each switch S1, S2, S3 and S4 can be formed with a metal oxide semiconductor field effect transistor (MOSFET), a reversal and parallel connected diode or an insulate gate bipolar transistor (IGBT).

FIG. 2 shows waveforms of the sustain driver having the energy recovery unit shown in FIG. 1. In FIG. 2, a waveform of the voltage Vp of the panel capacitor Cp, a waveform of the resonance current IL, and each waveform Vg(S1), Vg(S2), Vg(S3) and Vg(S4) of switch S1, S2, S3 and S4, are shown.

Referring to FIG. 2, the first and second sustain drivers 100 and 200 are operated by setting eight periods T1 to T8 as one cycle. The energy of Vsus/2, recovered from the panel capacitor Cp in the previous cycle, is stored in the external capacitor Ce of the first and second energy recovery units 10 and 20.

In the first period of T1, a current path is formed between the external capacitor Ce and the panel capacitor Cp by turning on the switch S3. At this time, the resonance current IL is formed by the resonance operation of the inductor Lr and the panel capacitor Cp so that the voltage Vp of the panel capacitor Cp increases up to the sustain voltage Vsus. As mentioned above, during the period of T1, the voltage Vp of the panel capacitor Cp increases up to the sustain voltage Vsus by a current transferred from the external capacitor Ce and the resonance current IL, however, in fact, a voltage drop Δ, i.e. an energy loss, is generated by a resistance of connection lines and by parasite resistances of devices in the PDP for the charging and discharging operations.

In the second period of T2, the voltage Vp of the panel capacitor Cp is sustained to the sustain voltage Vsus by turning on the switch S1. The switch S3, however, should be turned on for a ½ resonance cycle, and the switch 3 can be either turned on or turned off after the ½ resonance cycle.

In the third period of T3, the current path is formed between the panel capacitor Cp and the external capacitor Ce by turning off the switch S1 and turning on the switch S2. The energy stored in the panel capacitor Cp by the resonance operation of the inductor Lr and the panel capacitor Cp is recovered to the external capacitor Ce.

In the fourth period of T4, the voltage Vp of the panel capacitor Cp is sustained to the ground voltage 0V by turning on the switch S2. The switch S4, however, should be turned on for a ½ resonance cycle, and the switch 4 can be either turned on or turned after the ½ resonance cycle. Further, a closed-loop is formed by turning on a sixth switch S6 in the driving unit 22 of the second sustain driver 200 during the operation of four periods T1 to T4 in the first sustain driver 100.

Thereafter, the operations of four periods, T5 to T8, are performed in the second sustain driver 200. At this time, the voltage Vp of the panel capacitor Cp becomes the negative voltage. The operations of the switches S5 and S6 are the same with the first and second switches of the first sustain driver 100. A closed-loop is formed by turning on the second switch S2 in the driving unit 12 of the second sustain driver 200 during the operation of four periods T5 to T8 in the first sustain driver 100.

The power loss can be reduced by the conventional PDP comprising the energy recovery unit, and the panel capacitor Cp is charged and discharged with ½ resonance of the inductor $I_L$ and the panel capacitor Cp in the sustain drivers.

However, it is need to large area and high coast for manufacturing the sustain driver of the conventional PDP having the energy recovery unit because two energy recovery units are places symmetrically with the panel capacitor as a center.

SUMMARY OF THE INVENTION

It is, therefore, an object of the present invention to provide an apparatus of sustain driver in AC-type plasma display panel having energy recovery unit capable of reducing the area and cost.

In accordance with an aspect of the present invention, there is provide an apparatus of a sustain driver in an AC-type plasma display panel having an energy recovery unit, comprising: a first drive means for driving one electrode of a panel capacitor to a sustain voltage or a ground voltage; a second drive means for driving another electrode of the panel capacitor to a sustain voltage or a ground voltage; and a common energy recovery means. The common energy recovery means includes: an inductor connected to the one electrode of the panel capacitor and form a L-C resonance circuit with the panel capacitor; a first and second external capacitors connected in series between the power source of the sustain voltage and the ground; and a switch means for selectively switching the L-C resonance circuit and the first and second external capacitors during the charge and discharge operation of the panel capacitor.

BRIEF DESCRIPTION OF THE DRAWINGS

The above and other objects and features of the instant invention will become apparent from the following description of preferred embodiments taken in conjunction with the accompanying drawings, in which.

The FIG. 1 is a circuit diagram showing a conventional weber-type sustain driver of the plasma display panel(PDP) having an energy recovery unit.

DETAILED DESCRIPTION OF THE PREFERRED EMBODIMENTS

In the present invention, a energy recovery unit is commonly connected to two sustain drivers. A first and second external capacitors are connected in serial between a power source of the sustain voltage Vsus and a ground. The first and second external capacitor are connected to one and another electrode of the panel capacitor, respectively, in order to supply and recovery energy in the charge and discharge operations.

Hereinafter, a sustain driver in the plasma display panel (PDP) having an energy recovery unit according to the present invention will be described in detail referring to the accompanying drawings.

Figure 1:
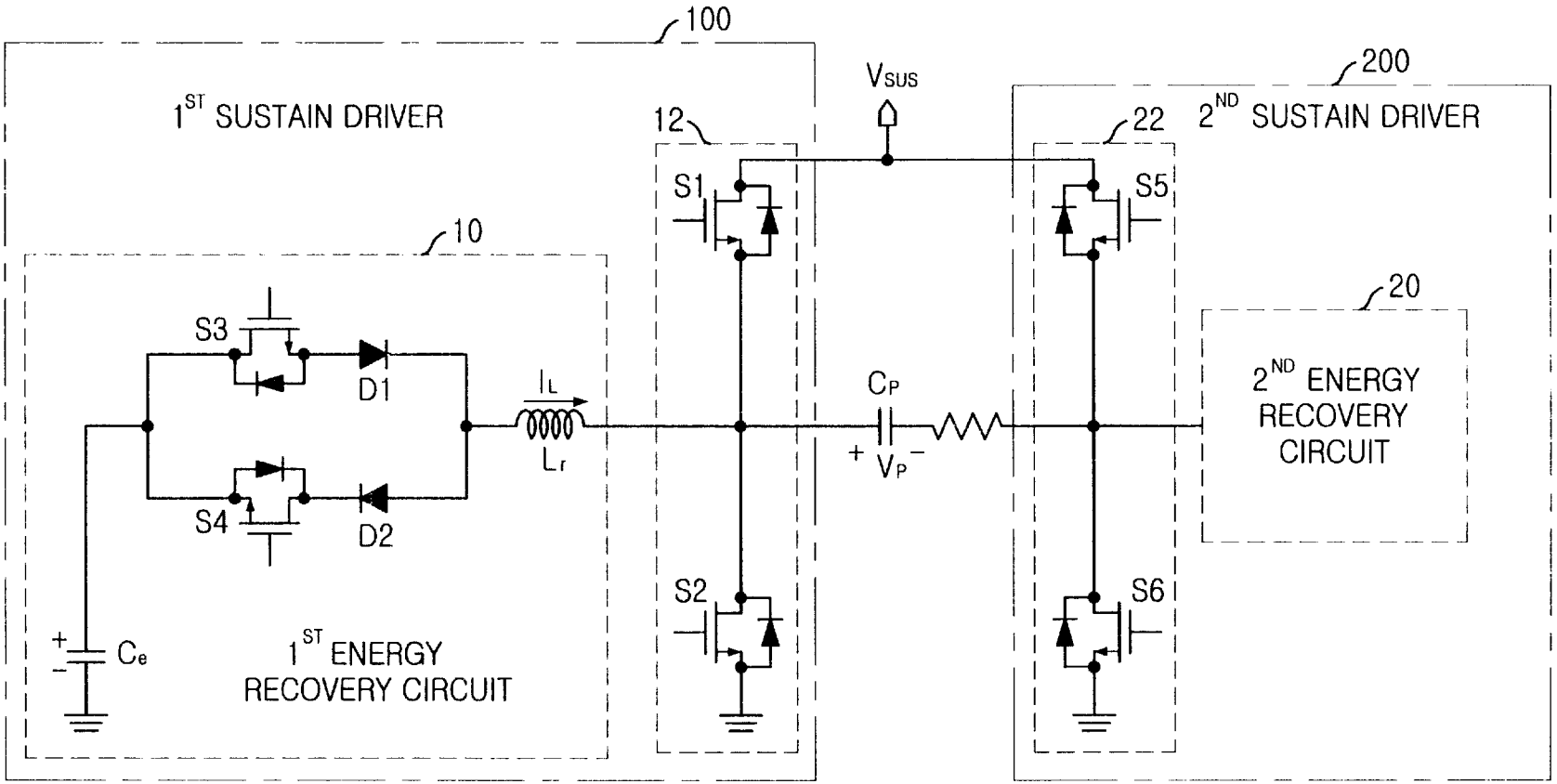
FIG. 1 (PRIOR ART)
Figure 2:
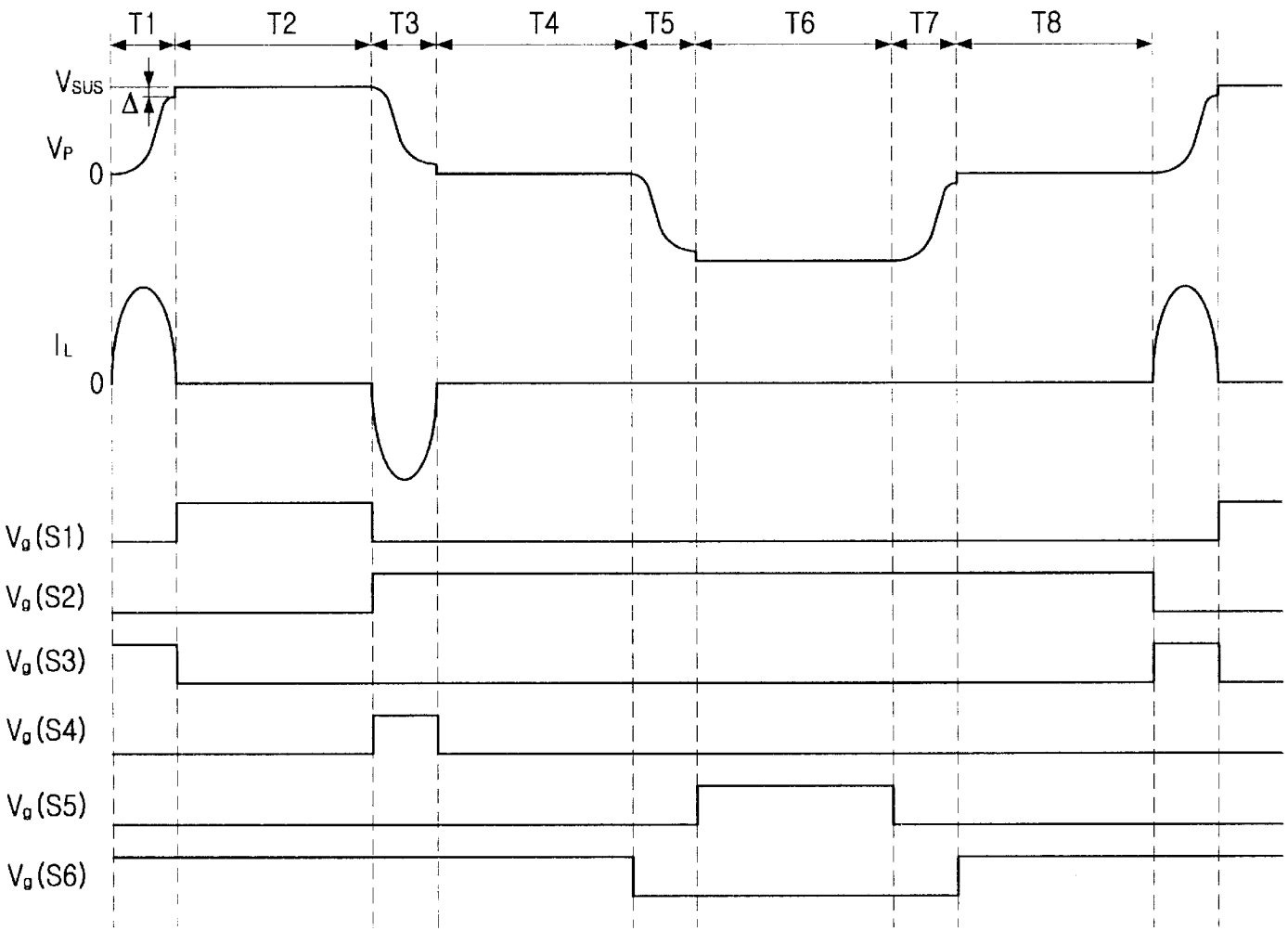
FIG. 2 (PRIOR ART)
FIG. 2 is a diagram showing waveforms of operating the sustain driver in the PDP shown in FIG. 1.
Figure 3:
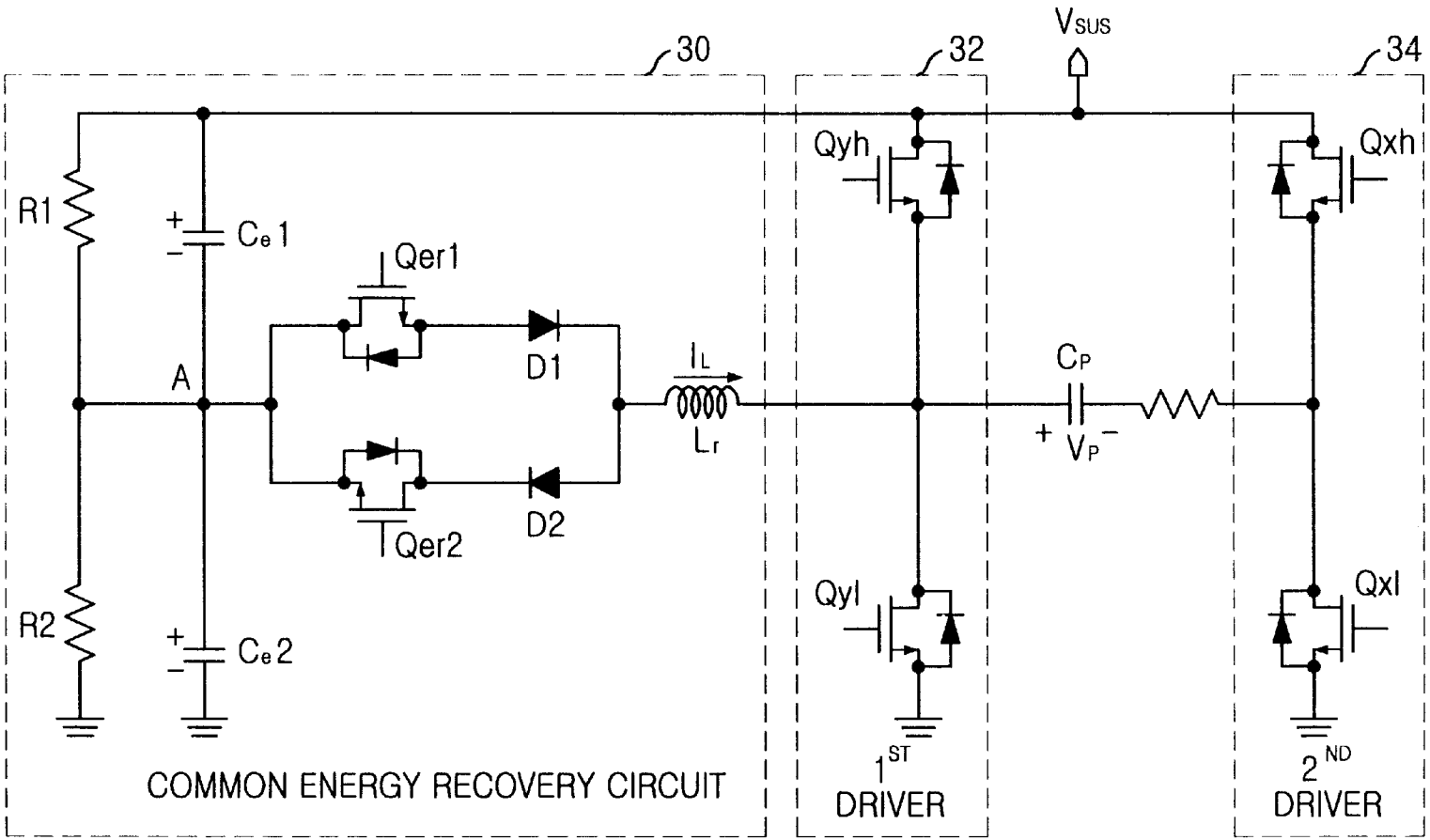
FIG. 3 is a circuit diagram showing a sustain driver in the PDP having the energy recovery unit of the present invention.

FIG. 3 is a circuit diagram showing a sustain driver in a PDP having the energy recovery unit of the present invention.

In FIG. 3, the sustain driver of the PDP having the energy recovery unit includes a first driver 32 and a second driver 34 connected to a panel capacitor Cp representing the panel and a common energy recovery unit 30 for recovering the energy loss during the discharge operation of the panel capacitor and supplying the recovered energy to the panel capacitor. In the present invention, one energy recovery unit 30 is shared with two sustain drivers instead of using the separate energy recovery unit in each sustain driver.

The first driver 32 includes a pull-up switch Qyh connected between the power source of the sustain voltage Vsus and the panel capacitor Cp in order to drive the panel capacitor Cp to the sustain voltage Vsus and a pull-down switch Qyl connected between the ground and the panel capacitor Cp in order to drive the panel capacitor Cp to the ground voltage.

The second driver 34 includes a pull-up switch Qxh connected between the power source of the sustain voltage Vsus and the panel capacitor Cp in order to drive the panel capacitor to the sustain voltage Vsus and a pull-down switch Qxl connected between the ground and the panel capacitor Cp in order to drive the panel capacitor Cp to the ground voltage.

The common energy recovery unit 30 includes an inductor Lr connected to the panel capacitor Cp for operating ½ resonance, a first external capacitor Ce1 and a second external capacitor Ce2 connected in series between the power source of the sustain voltage and the ground in order to store recovered energy during the resonance operation of the inductor Lr and the panel capacitor Cp, a first and a second switches Qer1 and Qer2 connected in parallel between node A and the inductor Lr for switching the energy recovery path, a first and a second diodes D1 and D2 connected between each switch of Qer1 and Qer2 and the inductor Lr for preventing the reverse of the resonance current and two resistors R1 and R2 connected in series between the power source of sustain voltage Vsus and the ground in order to form a voltage divider. The first external capacitor Ce1 and the second external capacitor Ce2 are designed to get the same capacity values. However, such capacitors may not sustain the Vsus/2 value because the capacitors are sensitive under environmental circumstances such as its temperature. By forming the voltage divider using two identical resistors R1 and R2 in the circuit, the stable potential can be sustained in node A.

Each of switches Qer1, Qer2, Qxh, Qxl, Qyh and Qyl can be formed with a metal oxide semiconductor field effect transistor (MOSFET), reversely parallel-connected diodes or an insulate gate bipolar transistor (IGBT).

Figure 4:
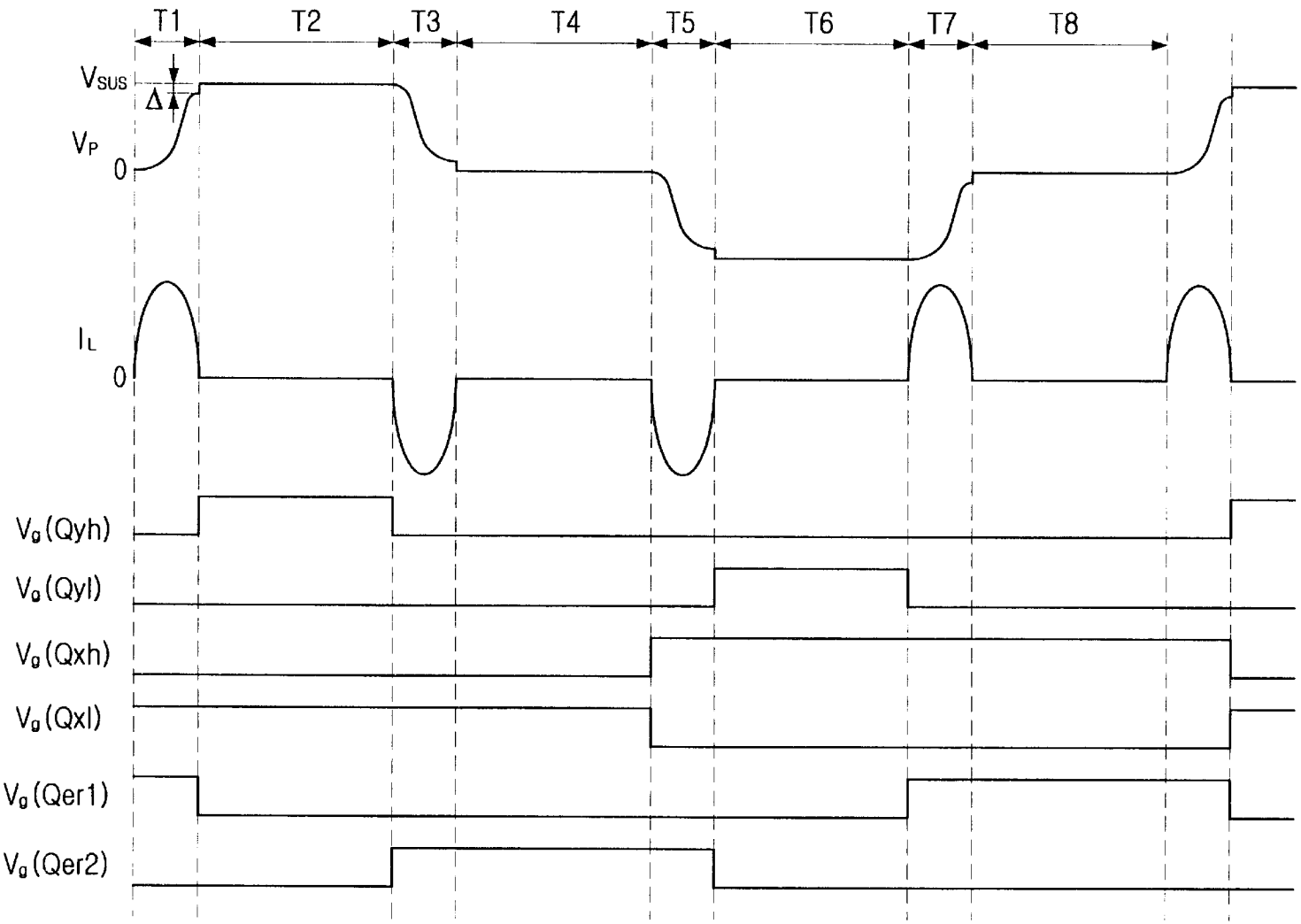
FIG. 4 is a diagram showing waveforms of the sustain driver in the PDP having the energy recovery unit shown in FIG. 3.

FIG. 4 is a diagram showing waveform of the sustain driver in the PDP having the energy recovery unit of FIG. 3. The waveform of the gate voltage Vg in each of switches Qer1, Qer2, Qxh, Qxl, Qyh and Qyl, the waveform of voltage Vp of the panel capacitor and the waveform of the current flowing in the inductor Lr are shown in FIG. 4.

In FIG. 4, the first driver 32 and the second driver 34 and the common energy recovery unit 30 are operated by setting eight periods T1 through T8 as one cycle. The energy of Vsus/2 recovered from the panel capacitor Cp in the previous cycle is stored in the first and second external capacitors Ce1 and Ce2 of the common energy recovery unit 30.

In the first period of T1, the voltage Vp of the panel capacitor Cp increases up to the sustain voltage Vsus by turning on the switch Qer1 and the switch Qxl in the second driver 34. That is, the second external capacitor Ce2, the switch Qer1, the first diode D1, the inductor Lr, the panel capacitor Cp and the switch Qxl in the second driver 34 form a closed-loop to flow resonance current $I_L$ by the resonance operation of the inductor Lr and the panel capacitor Cp in order to charge the panel capacitor Cp up to the sustain voltage Vsus.

In the second period of T2, the voltage Vp of the panel capacitor Cp is sustained at the sustain voltage Vsus by turning on the switch Qer1 and turning off the switch Qyh in the driver 32. That is, the power source of sustain voltage Vsus, the switch Qyh in the first driver 32, the panel capacitor Cp and the switch Qxl in the second driver 34 form a closed-loop.

In the third period of T3, the voltage Vp of the panel capacitor is dropped to the ground voltage by turning off the switch Qyh in the driver 32 and turning on the switch Qer2. That is, the switch Qxl in the second driver 34, the panel capacitor Cp, the inductor Lr, the second diode D2, the switch Qer1 and the second external capacitor Ce2 form a closed-loop to flow resonance current $I_L$ by the resonance operation of the inductor Lr and the panel capacitor Cp in order to discharge the panel capacitor Cp and recover the discharged energy to the second external Ce2.

In the fourth period of T4, the voltage Vp of the panel capacitor Cp is sustained to the ground voltage 0V for a predetermined time by sustaining the states of all the switches.

In the fifth period of T5, the voltage Vp of the panel capacitor Cp is dropped to −Vsus by turning off the switch Qxl and turning on the switch Qxh. That is, the first external capacitor Ce1, the switch Qxl, the panel capacitor Cp, the inductor Lr, the second diode D2 and the switch Qer2 form a closed-loop in order to charge the panel capacitor Cp.

In the sixth period of T6, the voltage Vp of the panel capacitor Cp is sustained to −Vsus by turning off the switch Qer2 and turning on the switch Qyl in the first driver 32. That is, the power source of the sustain voltage Vsus, the switch Qxh in the second driver 34, the panel capacitor Cp and the switch Qyl in the first driver 32 form a closed-loop.

In the seventh period of T7, the voltage Vp of the panel capacitor Cp is dropped to the ground voltage by turning off the switch Qyl and turning on the switch Qer1. That is, the second external capacitor Ce2, the switch Qer1, the first diode D1, the inductor Lr, the panel capacitor Cp, the switch Qxh in the second driver 34 form a closed-loop to flow resonance current IL by the resonance operation of the inductor Lr and the panel capacitor Cp in order to discharge the panel capacitor Cp and recover the discharged energy to the second external Ce2.

In the eighth period of T8, the voltage Vp of the panel capacitor Cp is sustained the ground voltage 0V for a predetermined time by sustaining the sates of all the switches.

In the above mentioned description, the voltage divider formed with the two resistors is adopted to the PDP. However, such a voltage divider can be omitted.

As mentioned above, the PDP according to the present invention adopts one energy recovery unit, therefore it is possible to reduce area of panel drive circuit and cost.

While the present invention has been described with respect to the particular embodiments, it will be apparent to those skilled in the art that various changes and modifications may be made without departing from the spirit and scope of the invention as defined in the following claims.

What is claimed is:

1. An apparatus of a sustain driver in an AC-type plasma display panel having an energy recovery unit, comprising:

a first drive means for driving one electrode of a panel capacitor to a sustain voltage or a ground voltage;

a second drive means for driving another electrode of the panel capacitor to a sustain voltage or a ground voltage; and a common energy recovery means, wherein the common energy recovery means includes:

an inductor connected to the one electrode of the panel capacitor and form a L-C resonance circuit with the panel capacitor;

a first and second external capacitors connected in series between the power source of the sustain voltage and the ground; and a switch means for selectively switching the L-C resonance circuit and the first and second external capacitors during the charge and discharge operation of the panel capacitor.

2. The apparatus as recited in claim 1, wherein the switch means includes:

a first switch and a second switch connected in parallel between the inductor and a contact point of the first external capacitor and the second external capacitor; and a first diode and a second diode connected between the inductor and the first and the second switches, respectively, for preventing a reverse of the resonance current.

3. The apparatus as recited in claim 2, the first external capacitor and the second external capacitor have the identical capacity.

4. The apparatus as recited in claim 3, wherein the common energy recovery means includes a voltage stabilization means for stabilizing the voltages of the first external capacitor and the second external capacitor.

5. The apparatus as recited in claim 4, wherein the voltage stabilization means includes two resistors having the same resistance, connected in series between the power source of the sustain voltage and the ground.

6. The apparatus as recited in claim 2, wherein the first drive means includes:

a first pull-up switch connected between the power source of the sustain voltage and the panel capacitor; and a first pull-down switch connected between the ground and the panel capacitor.

7. The apparatus as recited in claim 6, wherein the second drive means includes:

a second pull-up switch connected between the power source of the sustain voltage and the panel capacitor; and a second pull-down switch connected between the ground and the panel capacitor.

8. The apparatus as recited in claim 7, wherein the second pull-down switch forms a closed-loop with the second external capacitor, the inductor and the panel capacitor during the charge and the discharge operations of the panel capacitor.

9. The apparatus as recited in claim 7, wherein the second pull-up switch forms a closed-loop with the first external capacitor, the inductor and the panel capacitor during the charge and the discharge operations of the panel capacitor.

10. The apparatus as recited in claim 8, wherein the second external capacitor stores recovered energy during the charge and the discharge operations of the panel capacitor.

11. The apparatus as recited in claim 10, wherein the first external capacitor stores recovered energy during the charge and the discharge operations of the panel capacitor.

* * * * *